United States Patent [19]

Goff et al.

[11] 4,336,927

[45] Jun. 29, 1982

[54] LIGHT-WEIGHT JAM-CLAMP AND COMBINATION

[76] Inventors: Otis W. Goff, 5221 Woodmont Dr., Kalamazoo, Mich. 49001; Melvin J. Goff, 2454 52nd, SW., Wyoming, Mich. 49509

[21] Appl. No.: 148,188

[22] Filed: May 8, 1980

[51] Int. Cl.[3] ..... B25B 5/02

[52] U.S. Cl. ..... 269/171.5; 269/254 R; 269/238

[58] Field of Search ..... 269/165–171.5, 269/254 R, 238; 128/325; 29/221, 225, 229, 243, 56, 268; 81/418–420, 421–424, 302; 24/73 A, 73 SB, 115 G, 201 TR, 252 R, 263 R, 263 SB, 284; 248/226.3, 226.1, 316 A, 316 C

[56] References Cited

U.S. PATENT DOCUMENTS

| | | | |
|---|---|---|---|
| 1,617,703 | 2/1927 | Christianson | 81/424 X |
| 1,760,346 | 5/1930 | Correa | 248/226.1 X |
| 2,487,997 | 11/1949 | West | 269/254 X |
| 2,887,110 | 5/1959 | Roeschmann | 29/225 X |

FOREIGN PATENT DOCUMENTS

| | | | |
|---|---|---|---|
| 2364509 | 6/1975 | Fed. Rep. of Germany | 29/229 |
| 547992 | 9/1942 | United Kingdom | 269/171.5 |

*Primary Examiner*—Robert C. Watson
*Attorney, Agent, or Firm*—Gordon W. Hueschen

[57] ABSTRACT

There is provided a light-weight jam clamp in which the clamp is set by a tool and released by the same, or another tool. The tool forces one element of the clamp down against the work piece and causes it to jam on another element of the clamp. The setting tool can be an expansion bit pliers or a contraction bit pliers and the releasing tool is an expansion bit pliers. One face of the other element has serried lands to effect a positive jam action and prevent accidental dislodgment of the jam.

22 Claims, 18 Drawing Figures

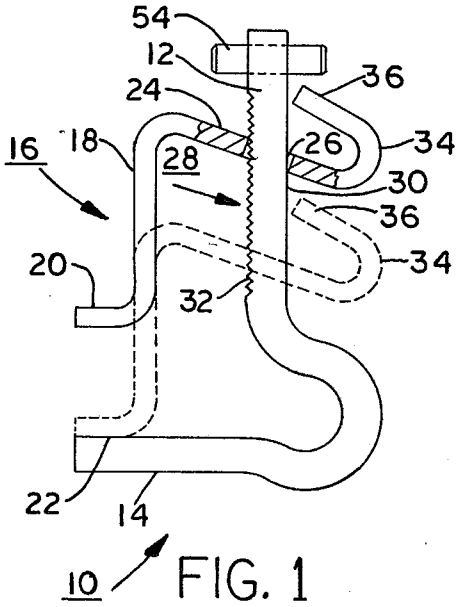
FIG. 1
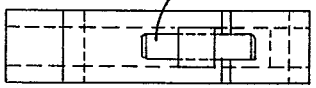
FIG. 2
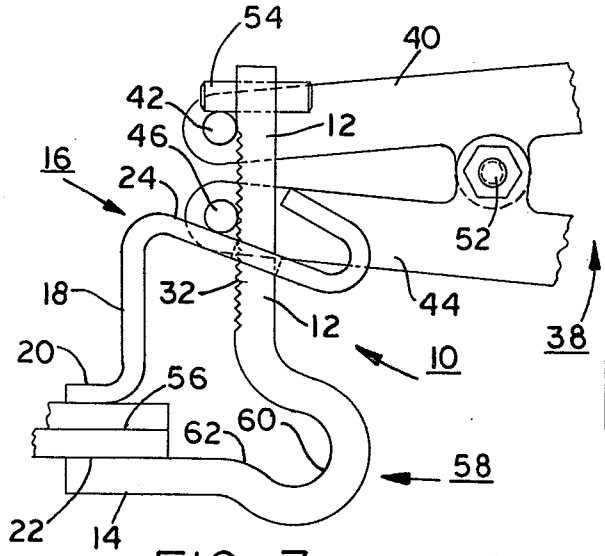
FIG. 3
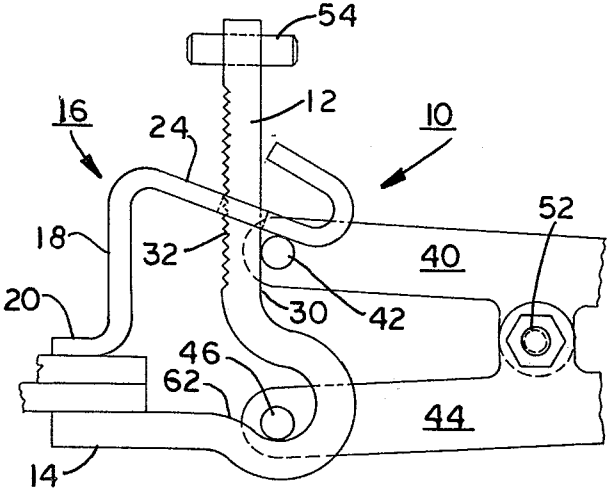
FIG. 4
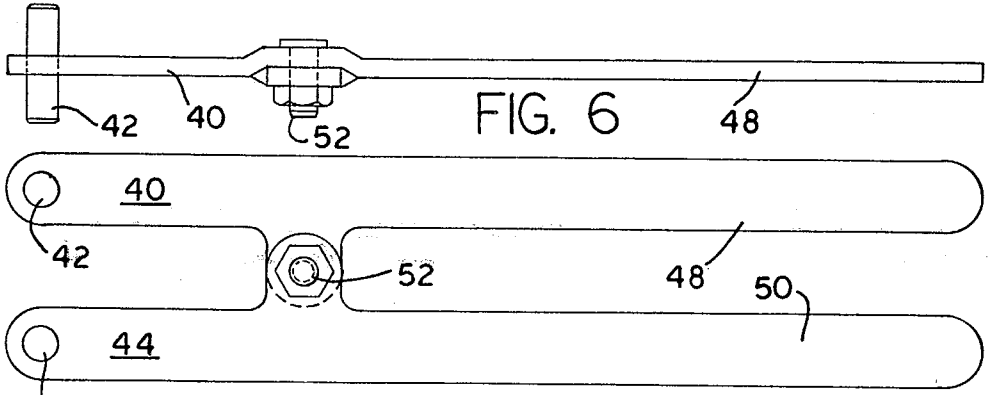
FIG. 6
FIG. 5

LIGHT-WEIGHT JAM-CLAMP AND COMBINATION

FIELD OF INVENTION AND PRIOR ART

The invention relates to a light-weight jam-clamp and combination therewith, of means for setting and releasing said jam-clamp, and is particularly directed to such clamps and combinations useful for holding sheets of metal together during fabrication.

In the airplane industry and like industries which fabricate products from sheet metal, especially large expanses of sheet metal, it is sometimes necessary to clamp such sheets together during fabrication. The clamps heretofore available for this purpose have been heavy and cumbersome as a rule, and are slow-acting and subject to breakage.

OBJECTS OF THE INVENTION

It is an object of the invention to provide a light-weight jam-clamp and light-weight jam-clamp combination which avoids the disadvantages of the art. It is a further object of the invention to provide such a clamp and combination which is light-weight and fast-acting. It is a further object of the invention to provide such a clamp and combination in which the clamp is reusable over a long period. It is a further object of the invention to provide such a clamp and combination in which the means for setting and releasing the clamp is separable, usable with many clamps, and out of the way during work on the work pieces. Further objects of the invention will appear as the description proceeds.

BRIEF DESCRIPTION OF THE INVENTION

The invention relates to a light-weight jam-clamp combination comprising clamping faces adapted to be held in clamping position by releasably jamming one element of the clamp against another element thereof in combination with jamming and releasing means separable from the elements, whereby the clamp is unencumbered by the jamming and releasing means while the clamp is functioning as a clamp.

Advantageously, one of the elements of the clamp is an upstanding leg and the other is a laterally-extending arm adapted to fit over and jam against the upstanding leg, and in which the jamming and releasing means comprises an expansion bit pliers means, one bit of which is provided with leg-engaging means and the other bit of which is provided with arm-engaging means, which leg-engaging means is operative in one position to engage a portion of the upstanding leg above the arm while the arm-engaging means is in engagement with the top side of the laterally-extending arm so that expansion of the bits forces the laterally-extending arm downward to set the jam and, in another position, to engage a portion of the upstanding leg below the laterally-extending arm while the arm-engaging means is in engagement with the underside of the laterally-extending arm, so that expansion of the bits forces the laterally-extending arm upward to release the jam.

More particularly, the combination comprises a spring clamp and a pair of expansion bit pliers adapted for setting and releasing the spring clamp in which the spring clamp comprises presser foot means extending upward from the first clamping face and having a laterally-extending arm which has an aperture therein in which is disposed an upstanding leg associated with the second clamping face opposed to the first clamping face, which aperture is of such size and in such a position that, when the front portion of the laterally-extending arm angles upward while the front and rear edges of the aperture are in contact, respectively, with the front and rear surfaces of the upstanding leg, it forms acute angles with the upper front surface of the upstanding leg and the lower rear surface thereof, and in which one of the bits of the pliers is shaped to engage the upstanding leg and the laterally-extending arm in one of the acute angles, and in which holding means is provided to cause the other bit of the pliers to engage the upstanding leg so that, on expansion of the bits, the laterally-extending arm is either pressed down against the upstanding leg or upward, depending on which angle the one bit is in.

Advantageously, each bit has a transverse member, one of which is adapted to fit in one of the acute angles and the other of which forms part of the holding means, which holding means in one form of the invention may comprise an irregular shape in or on the upstanding leg adapted to cooperate with the other of the transverse member to form a holding means or, in another form of the invention, a transverse slot in the other of the transverse member which is just wide enough to receive the upstanding leg so that, when the bits are canted on expansion thereof, the slot will jam against the upstanding leg to form the holding means and thus prevent relative movement of the other bit and the upstanding leg. Advantageously, two such slots are provided which are separated a distance substantially equal to the width of the one transverse member so that one slot is to the front of the one transverse member and in position to engage the upstanding leg when the one transverse member is in the acute angle between the laterally-extending arm and the rear surface of the upstanding leg, and the other slot is to the rear of the one transverse member and in position to engage the upstanding arm when the one transverse member is in the acute angle between the laterally-extending arm and the front surface of the upstanding leg.

Advantageously, the irregularity of the upstanding leg comprises a rearwardly bowed-out portion in the lower portion thereof which, desirably, slopes to the horizontal to form a shoulder which forms part of the holding means. Absent this, it is desirable to provide a second transverse member on the same bit spaced apart sufficiently to straddle the upstanding leg at the bowed portion to cooperate with the other transverse member opposed thereto and the bowed-out portion to form the holding means.

The invention is also directed to a tool for setting and releasing a light-weight jam-clamp which comrises an expansion bit pliers means having transverse members projecting laterally from adjacent the free ends of the bits of the pliers means and parallel to each other. Advantageously, one of the transverse members has a slot therein which is normal to both bits in the closed position, which slot is just large enough to receive the upstanding leg.

In one form of the tool of the invention, one of the transverse members is bifurcated, thus providing two transverse members projecting from one bit which are parallel to each other and parallel to the transverse member on the other bit.

The invention is also directed to a light-weight clamp which comprises an L-shaped member, one leg of which is an upstanding leg and has front and rear parallel surfaces and the other leg of which is a horizontal leg projecting from the bottom of the upstanding leg; and a pressor foot having a downstanding arm which has, at its top, a laterally-extending arm and, at its bottom, a foot adapted to cooperate with a flat portion of the horizontal leg as clamping faces; the laterally-extending arm having an aperture therein spaced from the downstanding arm through which aperture the upstanding leg projects with a loose fit such that the laterally-extending arm forms an acute angle with the front surface of the upper portion of the upstanding leg when the front and rear edges of the aperture, respectively, engage the front and rear surfaces of the upstanding leg, and forms an angle with the downwardly-extending arm such that, when the laterally-extending arm forms the acute angles, the downstanding arm extends downwardly at an angle such that the foot is opposed to the flat portion of the horizontal leg which forms a clamping face and the pressor foot being formed of rigid material that is sufficiently resilient so that, when the pressor foot is pushed down in clamping position by pressing down on the laterally-extending arm, the latter can be pressed down sufficiently to cause the front and rear edges of the aperture to jam against the front and rear faces, respectively, of the upstanding leg, thereby to hold the pressor foot in clamping position.

Advantageously, the free end of the laterally-extending arm has stop means which prevents the forward portion of the same from dropping below the horizontal. Preferably, this stop means comprises a portion of the free end of the laterally-extending arm which is bent back on itself so that, when the free end thereof abuts the rear surface of the upstanding leg, the angle formed by the forward portion of the laterally-extending arm and the front upper surface of the upstanding leg is always an acute angle.

In a preferred form of the invention, one or both of the front and rear surfaces of the upstanding leg has serried transverse lands adapted to be engaged by an edge of the aperture. Advantageously, the front edge of the aperture forms a sharp angle with the laterally-extending arm, which angle is less than the obtuse angle formed between the laterally-extending arm and the lower front portion of the upstanding leg. Such an angle, advantageously, about 90 degrees or less, forms a sharp edge at the front edge of the aperture and the upper surface of the forward portion of the laterally-extending arm, which sharp edge engages under one of the lands to effect a jamming which is resistant to accidental jarring.

BRIEF DESCRIPTION OF THE DRAWINGS

In the drawings:

FIG. 1 is a side elevation of one form of a light-weight jam-clamp according to the invention.

FIG. 2 is a plan view of FIG. 1.

FIG. 3 is a side elevation of FIG. 1 with a setting and releasing tool in position to set the clamp.

FIG. 4 is a side elevation of the clamp of FIG. 1 with a setting and releasing tool in position to release the clamp.

FIG. 5 is a side elevation of the setting and releasing tool of FIGS. 3 and 4.

FIG. 6 is a plan view of FIG. 5.

DETAILED DESCRIPTION OF THE INVENTION

Figure 7:
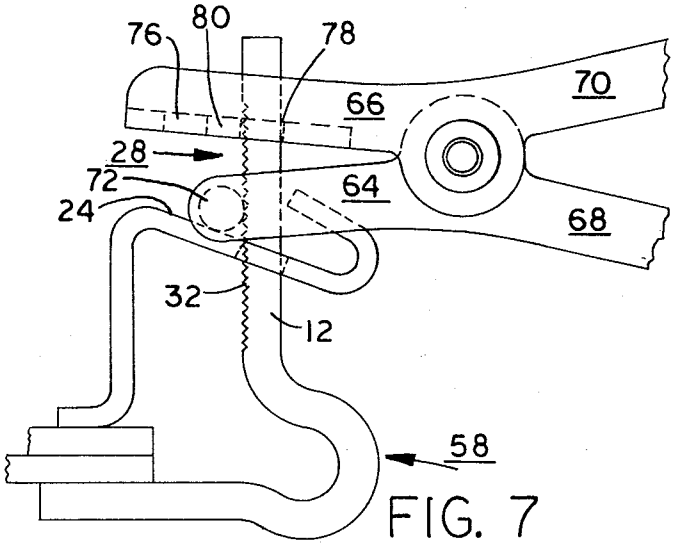
FIG. 7 is a plan elevation of a modified form of the invention with the setting and releasing tool in setting position.

Referring now particularly to FIGS. 1 through 6, FIG. 1 shows a light-weight jam-clamp according to the invention having an L-shaped member 10 provided with an upstanding leg 12 and a horizontal leg 14 projecting laterally from the bottom of the upstanding leg 12.

Mounted for up and down movement on the upstanding leg 12 is a pressor foot 16 having a downstanding arm 18 having a foot 20 at the bottom end thereof opposed to a flat portion 22 of the horizontal arm 14. The foot 20 and the flat portion 22 function as the clamping faces of the clamp. At the top of the downstanding arm 18 is a laterally-extending arm 24 having an aperture 26 therein through which the upstanding 12 projects.

The upstanding leg 12 has parallel front and rear surfaces 28 and 30, respectively, and the aperture 26 is just wide enough to slip over the upstanding arm 14 when the laterally-extending arm 24 is horizontal and to bind against the front and rear surfaces 28 and 30, as shown, when the laterally-extending arm 24 is canted upwardly, as shown.

The front surface 28 of the upstanding leg 12 is provided with serried lands 32 and the front edge of the aperture 26 is cut at an angle to provide a sharp edge on the upper surface to engage the lands. Preferably, the angle is 90 degrees, as shown, but it can be greater or smaller provided it is less than the obtuse angle formed between the undersurface of the arm 24 and the lower front surface of the upstanding leg 12.

If desired, the serried lands can be placed on the reverse surface 30, or they can be placed on both surfaces.

The free end of the laterally-extending arm 24 is bent back on itself, as shown at 34, so that the free end 36 is adjacent the rear surface 30 of the upstanding leg 14. This keeps the laterally-extending arm 24 from dropping down to below the horizontal position.

It is to be understood that the terms 'upstanding', 'horizontal,' 'downstanding,' and the like, used herein are used in a relative sense with reference to the position shown in the drawings and are used merely as a convenient way for describing the orientation of the various parts.

Referring now particularly to FIGS. 3 through 6, there is illustrated how the clamp of FIGS. 1 and 2 is set and released. For this purpose there is provided an expansion bit pliers 38, one bit 40 of which has a laterally-projecting pin 42 and the other bit 44 of which has a laterally-projecting pin 46, which is parallel to the pin 42. The pin 42 and 46 extend to both sides of the bits 40 and 44, as shown in FIGS. 5 and 6, which makes it possible when desired, to set the clamp or release it from either side.

The bits 40 and 44 are provided with handles 48 and 50, respectively, which are pivoted together at 52, so that when the handles 48 and 50 are gripped and squeezed together, the bits 40 and 44 are expanded.

The upstanding leg 12 is provided with a pin 54 which projects laterally from the front surface and functions as a stop for the pin 42. When the pins 42 and 46 are inserted in the position shown in FIG. 3, that is, with the pin 42 contacting the front surface of the upstanding arm 14 and the bottom surface of the pin 54 and the pin 42 contacting the front surface of the upstanding leg 12 in the upper surface of the laterally-extending arm 24, squeezing the handles 48 and 50 together will cause expansion of the bits 40 and 44 and cause the pin 46 to press down on the laterally-extending arm 24 to press the foot 20 into contact with the work piece 56 and place it under pressure against the clamping face 22. Further expansion of the bits will then force the laterally-extending arm 24 down farther by the spring action of the pressor foot 16 until the front and rear edges of the aperture 26 bind against the front and rear surfaces of the upstanding leg 12 and thus jam the clamp into clamping position. The serried lands 32 are engaged by the upper sharp edge of the front portion of the aperture 26 and thus holds the clamp in clamping position against any disruptive effects of vibration, or the like.

For the purpose of effecting disengagement or release of the clamp, the upstanding leg 12 is provided at the bottom thereof with a bowed section 58 which projects rearwardly from the upstanding leg 12. The bowed section 58 has an arcuate inner surface 60 which slopes upwardly to the flat upper surface 22 of the horizontal leg 14 where it forms a hump or detent 62.

To disengage the clamp, the laterally-projecting pins 42 and 46 of the expansion bit pliers 38 are inserted in the position shown in FIG. 4. The pin 46 is placed in the arcuate surface 60 just to the rear of the hump or detent 62 and the pin 42 is placed in the angle formed by the bottom rear surface of the laterally-extending arm 24 and the rear surface 30 of the upstanding leg 12. In this position, squeezing the handles 48 and 50 together expands the bits and causes disengagement of the laterally-extend-arm 24. The hump or detent 62 prevents the pin 46 from sliding forward. Thus, the disengagement is effected easily and simply by squeezing the handles together.

The bowed portion 58 also functions as a handle for the operator to hold the clamp in position during the setting of the clamp. Also, the bowed-out portion functions to relieve the stresses which otherwise would be engendered in the metal when it is bent into the L-shaped position.

Figure 8:
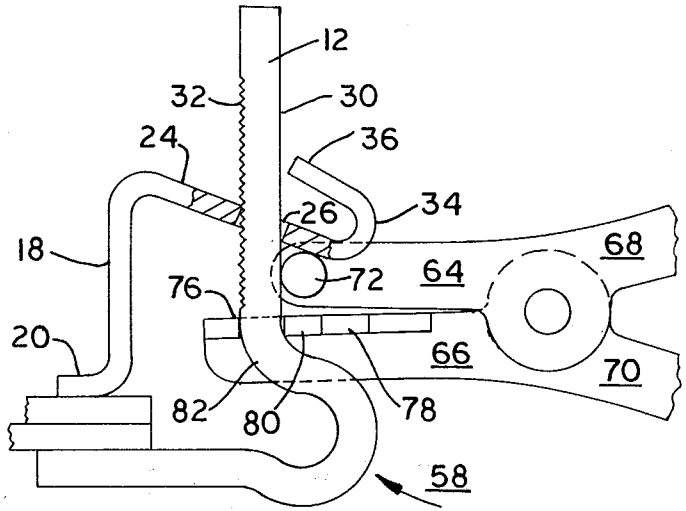
FIG. 8 is a side elevation of the clamp of FIG. 6 with the setting tool in releasing position.
Figure 9:
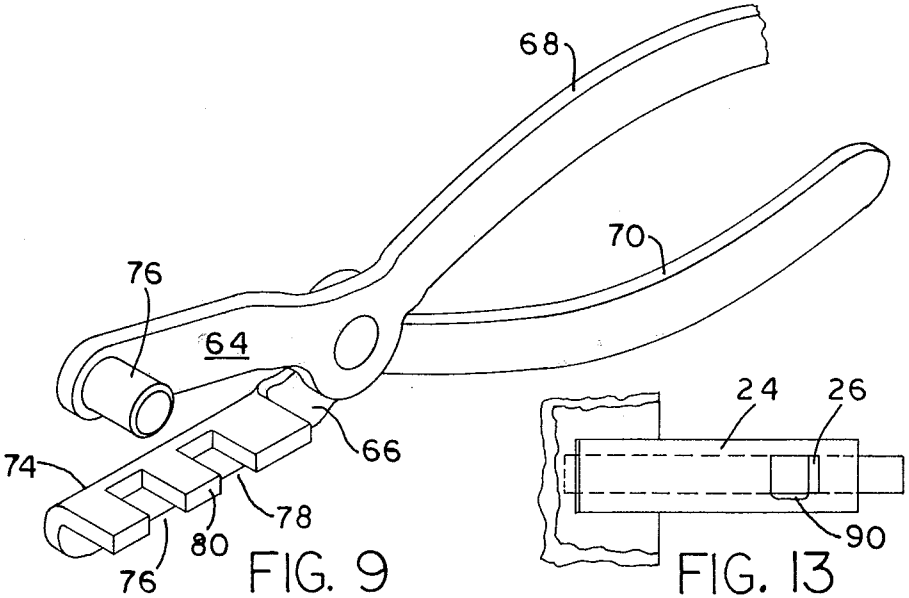
FIG. 9 is an isometric view of the setting and releasing tool of FIGS. 7 and 8.
Figure 13:
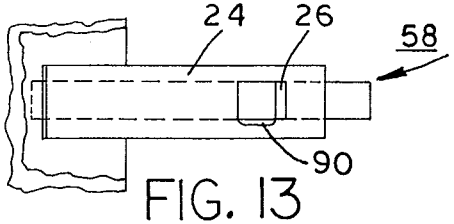
FIG. 13 is a plan view of FIG. 12.
Figure 12:
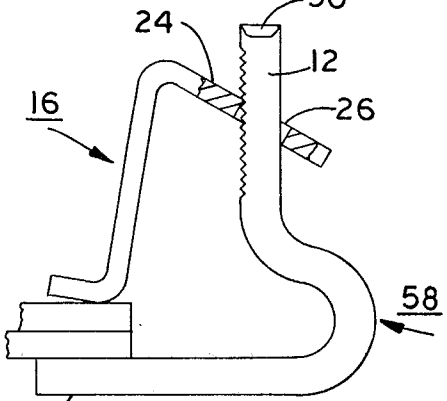
FIG. 12 is a side elevation of a further modification of the invention.
Figure 14:
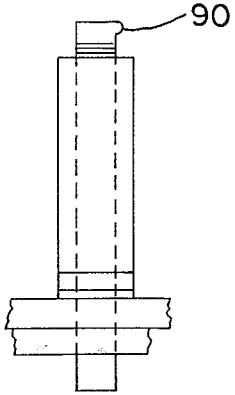
FIG. 14 is a front elevation of FIG. 12.

Referring now particularly to FIGS. 8 and 9, there will be seen a slightly different clamp and a different expanding bit pliers for setting and releasing the clamp. The clamp is essentially the same as that shown in FIG. 1, except that the pin 54 has been eliminated.

The expansion bit pliers means is best seen in FIG. 9. The tool has expansion bits 64 and 66 and complementary handles 68 and 70. The bit 64 has a transverse member 72 projecting laterally therefrom. The transverse member 72 can be a pin, as shown in FIGS. 5 and 6, or a roller, as shown in FIG. 9.

The bit 66 has a transverse plate 74 projecting laterally therefrom having an upper surface which is parallel and opposed to the transverse member 72. The transverse plate 74 has two slots 76 and 78 therein, the sides of which are parallel to each other and normal to the bit 66. The space 80 between the slots 76 and 78 is substantially the same width and is opposed to the transverse member 72. The slots 76 and 78 are just slightly wider than the upstanding leg 12, so that the tool can be positioned as shown in FIGS. 7 and 8. In FIG. 7, the slot 78 straddles the upstanding leg 12 and the transverse member is seated in the acute angle formed between the upper surface of the laterally-extending arm 24 and the upper portion of the front surface 28 of the upstanding leg 12. When the handles 68 and 70 are squeezed together, the bits 64 and 66 open to form an angle, as shown. As this angle increases, the front and rear edges of slot 78 bind against the front and rear surfaces of the upstanding arm 12, so that further squeezing of the handles forces the transverse member 72 down onto the laterally-extending arm 24 and jams it on the upstanding leg 12, as previously described, and as more particularly shown in FIG. 7.

To release the clamp, the tool is inverted and placed in the position shown in FIG. 8, where the slot 76 straddles the upstanding leg 12 and the transverse member 72 is seated in the acute angle formed between the undersurface of the laterally-projecting arm 24 and the lower portion of the rear surface 30 of the upstanding leg 12. Thus, when the handles 68 and 70 are squeezed together, the bits are expanded and the slot 76 is jammed on the upstanding leg 12 in the same manner as in FIG. 7 or, is jammed against the bend 82 at the bottom of the upstanding member 12.

Figure 10:
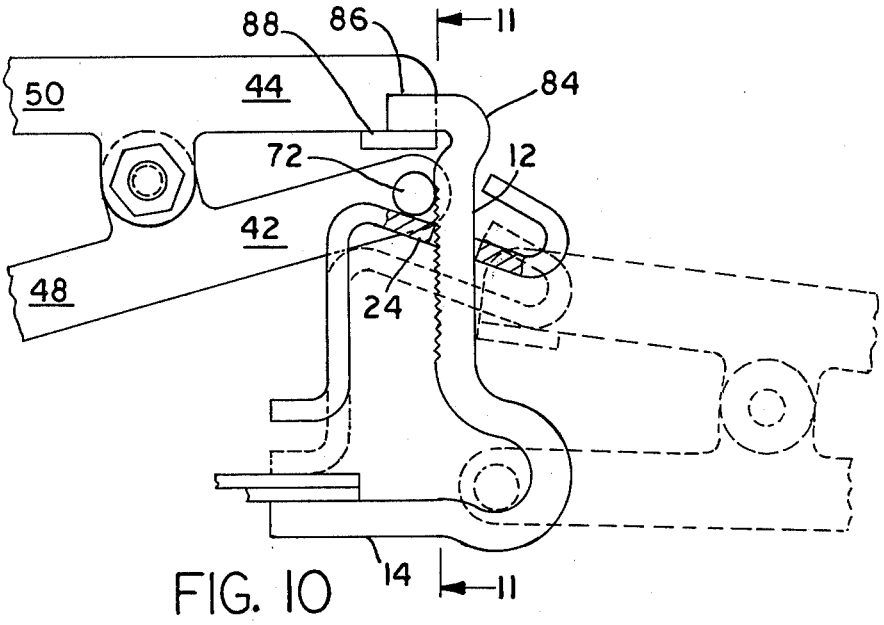
FIG. 10 is a side elevation of a modified form of the invention with the setting releasing tool shown in both setting and releasing positions.
Figure 11:
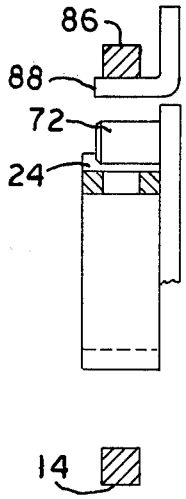
FIG. 11 is a cross-section taken along line 11—11 of FIG. 10.
Figure 16:
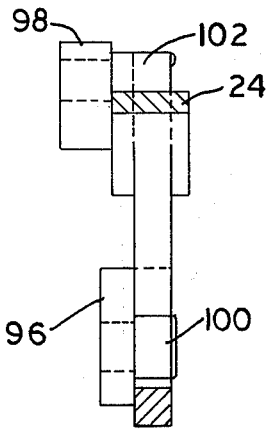
FIG. 16 is a cross-section taken along line 16—16 of FIG. 15.

Now referring to FIGS. 10 and 11, there is shown a modification of the invention in which the upstanding leg 12 is bent over at 84 to provide a stub 86 which is parallel to the horizontal leg 14 and functions in the same manner as pin 54 of FIGS. 1 through 4. The tool is similar in construction to that shown in FIGS. 5 and 6, but has a transverse member 72 like that shown in FIG. 7 on bit 42, whereas, on bit 44, it has a transverse plate 88 parallel to and opposed to the transverse member 72. In the seating position, the transverse member 72 is seated in the acute angle, just as in FIG. 7, and the transverse plate is seated under the stub 86, so that squeezing the handles 48 and 50 expands the bits 42 and 44 and forces the transverse member 72 down onto the laterally-extending member 24 and jams it on the upstanding leg 12, as already described. The dotted lines show the tool inverted to effect release of the clamp.

Figure 15:
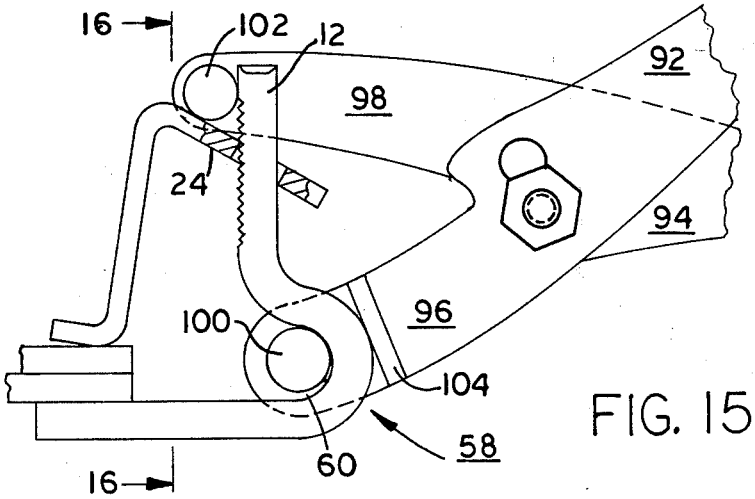
FIG. 15 is a side elevation of the clamp of FIG. 12 with the setting tool in setting position.

Referring now to FIGS. 12 through 18, there is shown another modification of the invention. The clamp is essentially the same as previously described, except that the upstanding leg 12 is not so long and has a detent 90 at the top to prevent the pressor foot 16 from being removed from the upstanding leg 12. In FIG. 15 there is shown a contraction bit pliers in which squeezing the handles 92 and 94 together causes the bits 96 and 98 to contract. Each of the bits 96 and 98 has at the other end thereof, transverse members 100 and 102, respectively, which, suitably, are the same as the transverse member 72, although the transverse member 100 can be of greater diameter than the transverse member 102, as long as it has a radius less than the radius of the arcuate surface 60. In setting the clamp, the transverse member 102 is seated in the acute angle formed between the laterally-extending arm 24 and the upper portion of the front surface of the upstanding leg 12, and the transverse member 100 is seated in the bowed portion 58 aganist the arcuate surface 60. A transverse plate 104 projects from the bit 96 parallel to the transverse member 100 and is spaced therefrom just slightly wider than the thickness of the upstanding arm 12 at the bowed portion. Now, squeezing the handles 92 and 94 compresses or contracts the bits 96 and 98 and forces the transverse members 100 and 102 toward each other. The transverse member 100 is held in the bowed portion 58 by the transverse plate 104, thus causing the transverse member 102 to press down on the laterally-extending arm 24 and set the clamp as previously described.

Figure 18:
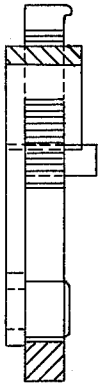
FIG. 18 is a cross-section taken along line 18—18 of FIG. 17.
Figure 17:
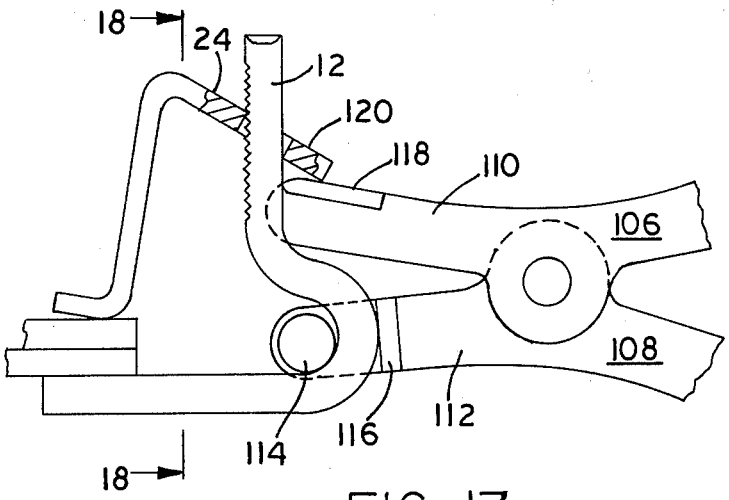
FIG. 17 is a side elevation of the clamp of FIG. 12 with a releasing tool in releasing position.

In order to release the clamp, an expansion bit pliers is provided, as shown in FIGS. 17 and 18. It comprises handles 106 and 108 and expansion bits 110 and 112. On expansion bit 112, there is provided a transverse member 114 like transverse member 100 and a transverse plate 116 opposed and parallel thereto, as in FIG. 15, which transverse member and transverse plate engage the upstanding leg 12 in the bowed portion 58 thereof, just as in FIG. 15. The expansion bit 110 has at the end thereof and opposed to the transverse member 114, a transverse plate 118, adapted to engage under the end 120 of the laterally-extending arm 24. Thus, squeezing the handles 106 and 108 together, causes the bits 110 and 112 to expand and to force the transverse plate 118 away from the transverse member 114, thus disengaging the laterally-extending arm 24.

In the operation of the spring clamp, a free clamp is positioned with the clamping faces in contact with the work piece, which, suitably, is two sheets of metal, as illustrated, and set in clamping position by a suitable tool, as described. As many of the clamps may be used as is necessary to make the desired clamping of the work piece, and in many industries, a large number of such clamps is need. Thus, in accordance with the invention, it is easy to set as many clamps as necessary and to leave them until the work is done on the work pieces without the work pieces being encumbered, as in the past, by means used to set the clamps. Moreover, the clamps of the invention are quick-acting, so that a single operator can seat a large number of clamps in a short time. As soon as the work is done on a work piece, the clamps are released by a tool, as described, and recovered for further use.

It is to be understood that the invention is not to be limited to the exact details of operation or structure shown and described, as obvious modifications and equivalents will be apparent to one skilled in the art.

We claim:

1. A light-weight jam-clamp combination comprising clamping faces adapted to be held in clamping position by releasably jamming one element of the clamp against another element thereof in combination with jamming and releasing means separable from said elements, whereby said clamp is unencumbered by said jamming and releasing means while said clamp is functioning as a clamp, in which said jamming and releasing means comprises an expansion bit pliers means, and in which one of said elements is an upstanding leg and the other is a laterally-extending arm adapted to fit over and jam against said upstanding leg, and in which leg-engaging means is provided on one bit of said expanding bit pliers and arm-engaging means is provided on the other bit thereof, said leg-engaging means being operative, in one position, to engage a portion of said leg above said arm while the arm-engaging means is in engagement with the top side of said laterally-extending arm, whereby expansion of said bit forces said laterally-extending arm downward to set the jam and, in another position, to engage a portion of said upstanding leg below said laterally-extending arm while said arm-engaging means is in engagement with the underside of said laterally-extending arm, whereby expansion of said bit forces said laterally-extending arm upward to release the jam.

2. A light-weight jam-clamp which comprises an L-shaped member, one leg of which is an upstanding leg and has front and rear parallel end faces and the other leg of which is a horizontal leg projecting from the bottom of said upstanding leg; and a pressor foot having a downstanding arm which has, at its top, a laterally-extending arm which forms an acute angle with said downstanding arm at the junction therewith and, at its bottom, a foot adapted to cooperate with a flat portion of said horizontal leg as clamping faces; said laterally-extending arm having an aperture therein spaced from said downstanding arm through which aperture said upstanding leg projects with a loose fit such that said laterally-extending arm forms an acute angle with the front surface of the upper portion of said upstanding leg when the front and rear edges of said aperture, respectively, engage the front and rear surfaces of said upstanding leg at the junction therewith which is complementary with the acute angle between said laterally-extending arm and said downstanding arm such that, when said clamp is in clamping engagement, said downstanding arm is substantially normal to said horizontal leg which forms a clamping face, and at least one of said other legs and said pressor foot being formed of rigid material that is sufficiently resilient so that, when said pressor foot is pressed down into clamping position by pressing down on said laterally-extending arm, said laterally-extending arm can be pressed down sufficiently to cause the front and rear edges of said aperture to jam against the front and rear end faces, respectively, of said upstanding leg, thereby to hold the pressor foot in clamping position.

3. A light-weight jam-clamp which comprises an L-shaped member, one leg of which is an upstanding leg and has front and rear parallel end faces and the other leg of which is a horizontal leg projecting from the bottom of said upstanding leg; and a pressor foot having a downstanding arm which has, at its top, a laterally-extending arm and, at its bottom, a foot adapted to cooperate with a flat portion of said horizontal leg as clamping faces; said laterally-extending arm having an aperture therein spaced from said downstanding arm through which aperture said upstanding leg projects with a loose fit such that said laterally-extending arm forms an acute angle with the front surface of the upper portion of said upstanding leg when the front and rear edges of said aperture, respectively engage the front and rear surfaces of said upstanding leg, and forms an angle with said downwardly-extending arm such that, when said laterally-extending arm forms said acute angles, said downstanding arm extends downwardly at an angle such that said foot is opposed to the flat portion of said horizontal leg which forms a clamping face, and said pressor foot being formed of rigid material that is sufficiently resilient so that, when said pressor foot is pressed down into clamping position by pressing down on said laterally-extending arm, said laterally-extending arm can be pressed down sufficiently to cause the front and rear edges of said aperture to jam against the front and rear end faces, respectively, of said upstanding leg, thereby to hold the pressor foot in clamping position, and in which the free end of said laterally-extending arm has stop means thereon which prevents the forward portion of said laterally-extending arm from dropping below the horizontal.

4. A light-weight jam-clamp of claim 3 in which said stop means comprises a portion of the free end of said laterally-extending arm which is bent back on itself so that, when the free end thereof abuts the rear surface of said upstanding leg, the angle formed by the forward portion of said laterally-extending arm and the front upper surface of said upstanding leg is always an acute angle.

5. A light-weight jam-clamp of claim 4, which further comprises pliers means operative to force said laterally-extending arm downward to press said foot against said work piece and to cause said laterally-extending arm to jam on said upstanding leg, and in which said pliers means is operative in another position to force said laterally-extending arm upward to disengage it from said upstanding leg.

6. A light-weight jam-clamp of claim 5, in which said pliers means is an expansion bit pliers means, one bit of which, in one position, engages the upper surface of said laterally-extending arm in the acute angle between it and the upper portion of said upstanding leg, and the other bit of which engages the upper portion of said upstanding leg so that, when said bits are expanded, said laterally-extending arm is pressed downward to cause the edges of said aperture to jam against said upstanding arm; and, in another position, said one bit engages the under surface of said laterally-extending arm in the acute angle that said arm forms with the rear surface of the lower portion of said upstanding leg and said other bit engages a lower portion of said upstanding leg so that, when said bits are expanded, said laterally-extending arm is disengaged.

7. A light-weight jam-clamp which comprises an L-shaped member, one leg of which is an upstanding leg and has front and rear parallel end faces and the other leg of which is a horizontal leg projecting from the bottom of said upstanding leg; and a pressor foot having a downstanding arm which has, at its top, a laterally-extending arm and, at its bottom, a foot adapted to cooperate with a flat portion of said horizontal leg as clamping faces; said laterally-extending arm having an aperture therein spaced from said downstanding arm through which aperture said upstanding leg projects with a loose fit such that said laterally-extending arm forms an acute angle with the front surface of the upper portion of said upstanding leg when the front and rear edges of said aperture, respectively, engage the front and rear surfaces of said upstanding leg, and forms an angle with said downwardly-extending arm such that, when said laterally-extending arm forms said acute angles, said downstanding arm extends downwardly at an angle such that said foot is opposed to the flat portion of said horizontal leg which forms a clamping face, and said pressor foot being formed of rigid material that is sufficiently resilient so that, when said pressor foot is pressed down into clamping position by pressing down on said laterally-extending arm, said laterally-extending arm can be pressed down sufficiently to cause the front and rear edges of said aperture to jam against the front and rear end faces, respectively, of said upstanding leg, thereby to hold the pressor foot in clamping position, which further comprises pliers means operative to force said laterally-extending arm downward to press said foot against said work piece and to cause said laterally-extending arm to jam on said upstanding leg, in which said pliers means is an expansion bit pliers means, one bit of which, in one position, engages the upper surface of said laterally-extending arm in the acute angle between it and the upper portion of said upstanding leg, and the other bit of which engages the upper portion of said upstanding leg so that, when said bits are expanded, said laterally-extending arm is pressed downward to cause the edges of said aperture to jam against said upstanding arm; and, in another position, said one bit engages the under surface of said laterally-extending arm in the acute angle that said arm forms with the rear surface of the lower portion of said upstanding leg and said other bit engages a lower portion of said upstanding leg so that, when said bits are expanded, said laterally-extending arm is disengaged, and in which said other bit has a transverse slot therein only slightly wider than said upstanding leg so that, when said one bit is in engagement with said laterally-extending arm and said upstanding leg is in said slot, expansion of said bits will cause said slot to bind on said upstanding leg so that further expansion of the bits will force said laterally-extending arm to move relative to said upstanding leg.

8. A light-weight jam-clamp which comprises an L-shaped member, one leg of which is an upstanding leg and has front and rear parallel end faces and the other leg of which is a horizontal leg projecting from the bottom of said upstanding leg; and a pressor foot having a downstanding arm which has, at its top, a laterally-extending arm and, at its bottom, a foot adapted to cooperate with a flat portion of said horizontal leg as clamping faces; said laterally-extending arm having an aperture therein spaced from said downstanding arm through which aperture said upstanding leg projects with a loose fit such that said laterally-extending arm forms an acute angle with the front surface of the upper portion of said upstanding leg when the front and rear edges of said aperture, respectively, engage the front and rear surfaces of said upstanding leg, and forms an angle with said downwardly-extending arm such that, when said laterally-extending arm forms said acute angles, said downstanding arm extends downwardly at an angle such that said foot is opposed to the flat portion of said horizontal leg which forms a clamping face, and said pressor foot being formed of rigid material that is sufficiently resilient so that, when said pressor foot is pressed down into clamping position by pressing down on said laterally-extending arm, said laterally-extending arm can be pressed down sufficiently to cause the front and rear edges of said aperture to jam against the front and rear end faces, respectively, of said upstanding leg, thereby to hold the pressor foot in clamping position, which further comprises pliers means operative to force said laterally-extending arm downward to press said foot against said work piece and to cause said laterally-extending arm to jam on said upstanding leg, in which said pliers means is an expansion bit pliers means, one bit of which, in one position, engages the upper surface of said laterally-extending arm in the acute angle between it and the upper portion of said upstanding leg, and the other bit of which engages the upper portion of said upstanding leg so that, when said bits are expanded, said laterally-extending arm is pressed downward to cause the edges of said aperture to jam against said upstanding arm; and, in another position, said one bit engages the under surface of said laterally-extending arm in the acute angle that said arm forms with the rear surface of the lower portion of said upstanding leg and said other bit engages a lower portion of said upstanding leg so that, when said bits are expanded, said laterally-extending arm is disengaged, and in which the upper and lower portions of said upstanding leg are provided with stop means which limits the expansion of said bits so that, in one position, the laterally-extending arm is pressed down and in the other position, it is pressed up.

9. A light-weight jam-clamp of claim 8, in which said bits have transverse portions, one of which is adapted to engage said stop means and the other of which is adapted to fit in the acute angle between said upstanding arm and said laterally-extending arm.

10. A light-weight jam-clamp which comprises an L-shaped member, one leg of which is an upstanding leg and has front and rear parallel end faces and the other leg of which is a horizontal leg projecting from the bottom of said upstanding leg; and a pressor foot having a downstanding arm which has, at its top, a laterally-extending arm and, at its bottom, a foot adapted to cooperate with a flat portion of said horizontal leg as clamping faces; said laterally-extending arm having an aperture therein spaced from said downstanding arm through which aperture said upstanding leg projects with a loose fit such that said laterally-extending arm forms an acute angle with the front surface of the upper portion of said upstanding leg when the front and rear edges of said aperture, respectively, engage the front and rear surfaces of said upstanding leg, and forms an angle with said downwardly-extending arm such that, when said laterally-extending arm forms said acute angles, said downstanding arm extends downwardly at an angle such that said foot is opposed to the flat portion of said horizontal leg which forms a clamping face, and said pressor foot being formed of rigid material that is sufficiently resilient so that, when said pressor foot is pressed down into clamping position by pressing down on said laterally-extending arm, said laterally-extending arm can be pressed down sufficiently to cause the front and rear edges of said aperture to jam against the front and rear end faces, respectively, of said upstanding leg, thereby to hold the pressor foot in clamping position, which further comprises pliers means operative to force said laterally-extending arm downward to press said foot against said work piece and to cause said laterally-extending arm to jam on said upstanding leg, in which said pliers means is an expansion bit pliers means, one bit of which, in one position, engages the upper surface of said laterally-extending arm in the acute angle between it and the upper portion of said upstanding leg, and the other bit of which engages the upper portion of said upstanding leg so that, when said bits are expanded, said laterally-extending arm is pressed downward to cause the edges of said aperture to jam against said upstanding arm; and, in another position, said one bit engages the under surface of said laterally-extending arm in the acute angle that said arm forms with the rear surface of the lower portion of said upstanding leg and said other bit engages a lower portion of said upstanding leg so that, when said bits are expanded, said laterally-extending arm is disengaged, and in which said bits have transverse portions, one of which is adapted to engage in the acute angle between said upstanding leg and said laterally-extending arm and the other of which has a transverse slot therein only slightly wider than said upstanding leg so that, when the other bit is engaged in said acute angle and said upstanding leg is in said slot, expansion of said bits will cause said slot to bind on said upstanding leg so that further expansion of the bits will force said laterally-extending arm to move relative to said upstanding leg.

11. A light-weight jam-clamp of claim 2, in which said upstanding leg has a section of the bottom portion thereof bowed out toward the rear in an arcuate curve which merges with said horizontal leg and in which said arcuate curve has a surface which extends down between the upper surface of said horizontal leg and slopes back up it to form a shoulder therewith.

12. A light-weight jam-clamp of claim 8, in which the stop means in the lower portion of said upstanding leg comprises a section thereof which is bowed out toward the rear and holding means for holding a transverse portion of one of said bits in said bowed-out section.

13. A light-weight jam-clamp of claim 12, in which said holding means comprises a second transverse portion parallel to the transverse portion which is adapted to engage said bowed-out section and is spaced therefrom just enough to receive said upstanding leg at the bowed-out section.

14. A light-weight jam-clamp of claim 12, in which said bowed-out section has a surface which drops below the upper surface of said horizontal leg and slopes back up to form a shoulder therewith which functions as a holding means.

15. A light-weight jam-clamp combination which comprises a spring clamp and a pair of expansion bit pliers means adapted for setting and releasing said spring clamp in which said spring clamp comprises pressor foot means extending upward from a first clamping face and having a laterally-extending arm which has an aperture therein in which is disposed an upstanding leg associated with a second clamping face opposed to said first clamping face, which aperture is of such size and in such a position that, when the front portion of said laterally-extending arm angles upward while the front and rear edges of said aperture are in contact, respectively, with the front and rear surfaces of said upstanding leg, it forms acute angles with the upper front surface of said upstanding leg and the lower rear surface thereof, and in which one of the bits of said pliers is shaped to engage said upstanding leg and said laterally-extending arm in one of said acute angles, and in which holding means is provided to cause the other bit of said pliers to engage said upstanding leg so that, on expansion of said bits, the laterally-extending arm is either pressed down against the upstanding leg or upward, depending on which angle said one bit is in.

16. A light-weight jam-clamp of claim 15, in which each of said bits has a transverse member, one of which is adapted to fit in one of said acute angles and the other of which forms part of said holding means.

17. A light-weight jam-clamp of claim 16, in which said upstanding leg has an irregular shaped portion adapted to cooperate with the other of said transverse members to form said holding means.

18. A light-weight jam-clamp combination which comprises a spring clamp and a pair of expansion bit pliers means adapted for setting and releasing said spring clamp in which said spring clamp comprises pressor foot means extending upward from a first clamping face and having a laterally-extending arm which has an aperture therein in which is disposed an upstanding leg associated with a second clamping face opposed to said first clamping face, which aperture is of such size and in such a position that, when the front portion of said laterally-extending arm angles upward while the front and rear edges of said aperture are in contact, respectively, with the front and rear surfaces of said upstanding leg, it forms acute angles with the upper front surface of said upstanding leg and the lower rear surface thereof, and in which one of the bits of said pliers is shaped to engage said upstanding leg and said laterally-extending arm in one of said acute angles, and in which holding means is provided to cause the other bit of said pliers to engage said upstanding leg so that, on expansion of said bits, the laterally-extending arm is either pressed down against the upstanding leg or upward, depending on which angle said one bit is in, in which each of said bits has a transverse member, one of which is adapted to fit in one of said acute angles and the other of which forms part of said holding means, and in which the other of said transverse members has a transverse slot therein just wide enough to receive said upstanding leg so that, when the bits are canted on expansion thereof, the slot will jam against said upstanding leg to form said holding means and thus prevent relative movement of said other bit and said upstanding leg.

19. A light-weight jam-clamp of claim 17, in which the irregular shape is formed by a rearwardly bowed-out section.

20. A light-weight jam-clamp of claim 19, in which said bowed-out section slopes down from and back up to the horizontal and forms a shoulder which forms a part of said holding means.

21. A light-weight jam-clamp of claim 19, in which said other transverse member is opposed to a second transverse member on the same bit spaced apart sufficiently to straddle said upstanding leg at the bowed section, said second transverse member cooperating with said other transverse member and said bowed-out section to form said holding means.

22. A light-weight jam-clamp of claim 10, in which said other transverse member has parallel transverse slots therein separated from each other a distance substantially equal to the width of said one transverse member.

* * * * *

UNITED STATES PATENT AND TRADEMARK OFFICE

CERTIFICATE OF CORRECTION

PATENT NO. : 4,336,927

DATED : June 29, 1982

INVENTOR(S) : Otis W. Goff and Melvin J. Goff

It is certified that error appears in the above-identified patent and that said Letters Patent is hereby corrected as shown below:

Col. 1, line 64; "presser" should read -- pressor --
Col. 1, line 68; "opposed" should read -- apposed --
Col. 2, line 53; "comrises" should read -- comprises --
Col. 9, line 21; "claim 4," should read -- claim 2, --

Signed and Sealed this

*Twelfth* Day of *October 1982*

[SEAL]

*Attest:*

GERALD J. MOSSINGHOFF

*Attesting Officer* *Commissioner of Patents and Trademarks*